US010739104B1

(12) United States Patent
Smith et al.

(10) Patent No.: US 10,739,104 B1
(45) Date of Patent: Aug. 11, 2020

(54) ROUTER SYSTEM

(71) Applicant: Hunter's Manufacturing Company, Inc., Suffield, OH (US)

(72) Inventors: Gary Smith, East Canton, OH (US); Keith Bartels, Akron, OH (US); Michael Shaffer, Mogadore, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 16/578,468

(22) Filed: Sep. 23, 2019

(51) Int. Cl.
*F41B 5/12* (2006.01)
*F41B 5/14* (2006.01)

(52) U.S. Cl.
CPC ..... *F41B 5/123* (2013.01); *F41B 5/14* (2013.01)

(58) Field of Classification Search
CPC ..... F41B 5/12; F41B 5/123; F41B 5/14
USPC ..... 124/25, 86
See application file for complete search history.

(56) References Cited

U.S. PATENT DOCUMENTS 4,649,891 A * 3/1987 Bozek ..... F41B 5/123 124/25
4,879,987 A * 11/1989 Nishioka ..... F41B 5/123 124/25
5,119,797 A * 6/1992 Anderson ..... F41B 5/143 124/24.1
7,823,572 B2 * 11/2010 Anderson ..... F41B 5/123 124/25
7,891,348 B2 * 2/2011 Colley ..... F41B 5/123 124/25
7,938,108 B2 * 5/2011 Popov ..... F41B 5/123 124/25
8,387,603 B2 * 3/2013 Darlington ..... F41B 5/10 124/23.1
8,522,762 B2 * 9/2013 Trpkovski ..... F41B 5/0094 124/25.6
8,627,811 B1 * 1/2014 Darlington ..... F41B 5/1426 124/25
8,651,095 B2 * 2/2014 Islas ..... F41B 5/105 124/25
8,991,375 B2 * 3/2015 McPherson ..... F41B 5/123 124/25
9,068,791 B2 * 6/2015 McPherson ..... F41B 5/123
9,200,863 B2 * 12/2015 Bednar ..... F41B 5/123
9,234,719 B1 * 1/2016 Kempf ..... F41B 5/105
9,255,757 B2 * 2/2016 McPherson ..... F41B 5/123
9,476,665 B2 * 10/2016 McPherson ..... F41B 5/123
9,500,433 B2 * 11/2016 McPherson ..... F41B 5/1403
9,671,189 B2 * 6/2017 McPherson ..... F41B 5/123
9,879,937 B2 * 1/2018 McPherson ..... F41B 5/123
9,879,939 B2 * 1/2018 McPherson ..... F41B 5/1403
10,145,641 B2 * 12/2018 Hout ..... F41B 5/1403
(Continued)

*Primary Examiner* — Alexander R Niconovich
(74) *Attorney, Agent, or Firm* — Emerson Thomson Bennett PLLC

(57) ABSTRACT

Provided is a crossbow router system comprising a first elongated frame defining a plurality of parallel rotational axes of the first frame; a second elongated frame defining a plurality of parallel rotational axes of the second frame; wherein multiple rotational axes of the first frame are coincident with one multiple rotational axes of the second frame; multiple elongated shafts with each shaft defining a shaft axis, each shaft being coincident with a rotational axis of the first elongated frame, and a rotational axis of the second elongated frame; and each shaft having a bushing thereon.

2 Claims, 8 Drawing Sheets

(56) References Cited

U.S. PATENT DOCUMENTS

| | | | | |
|---|---|---|---|---|
| 2010/0116259 | A1* | 5/2010 | Popov | F41B 5/105<br>124/25 |
| 2011/0030666 | A1* | 2/2011 | Darlington | F41B 5/105<br>124/25 |
| 2014/0069402 | A1* | 3/2014 | McPherson | F41B 5/123<br>124/25 |

* cited by examiner

ROUTER SYSTEM

CROSS-REFERENCE TO RELATED APPLICATIONS

N/A

BACKGROUND

The present subject matter is directed to apparatuses and methods regarding crossbows. More specifically the present subject matter is directed to apparatuses and methods for guiding the power cords for a crossbow.

Crossbows have been used for many years as a weapon for hunting and fishing, and for target shooting. Crossbows typically comprise a bowstring engaged through set of pulleys to a set of limbs and to a set of power cords. A bowstring is cocked to energize the crossbow and prepare it to fire. Energizing the crossbow stores energy in the bow using a mechanism comprising a set of cams or pulleys operationally engaged with the bow by a set of power cords that may extend across the bow. It is not uncommon for the power cords to extend across the bow by being routed through a hole in the main beam of the crossbow. In some crossbows the power cords are routed in such a way that they cause bending, warpage, misalignment, or other mechanical issues creating inefficiencies in the crossbow operation.

It remains desirable to improve the apparatuses and methods by which the power cords are routed in order to promote efficiency in crossbow operation.

SUMMARY

Provided is a crossbow router system comprising a first elongated frame defining a plurality of parallel rotational axes of the first frame; a second elongated frame defining a plurality of parallel rotational axes of the second frame; wherein multiple rotational axes of the first frame are coincident with one multiple rotational axes of the second frame; multiple elongated shafts with each shaft defining a shaft axis, each shaft being coincident with a rotational axis of the first elongated frame, and a rotational axis of the second elongated frame; and each shaft having a bushing thereon.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein:

FIG. 5 is a view of the crossbow comprising a power cord router of FIG. 4.

DEFINITIONS

Figure 1:
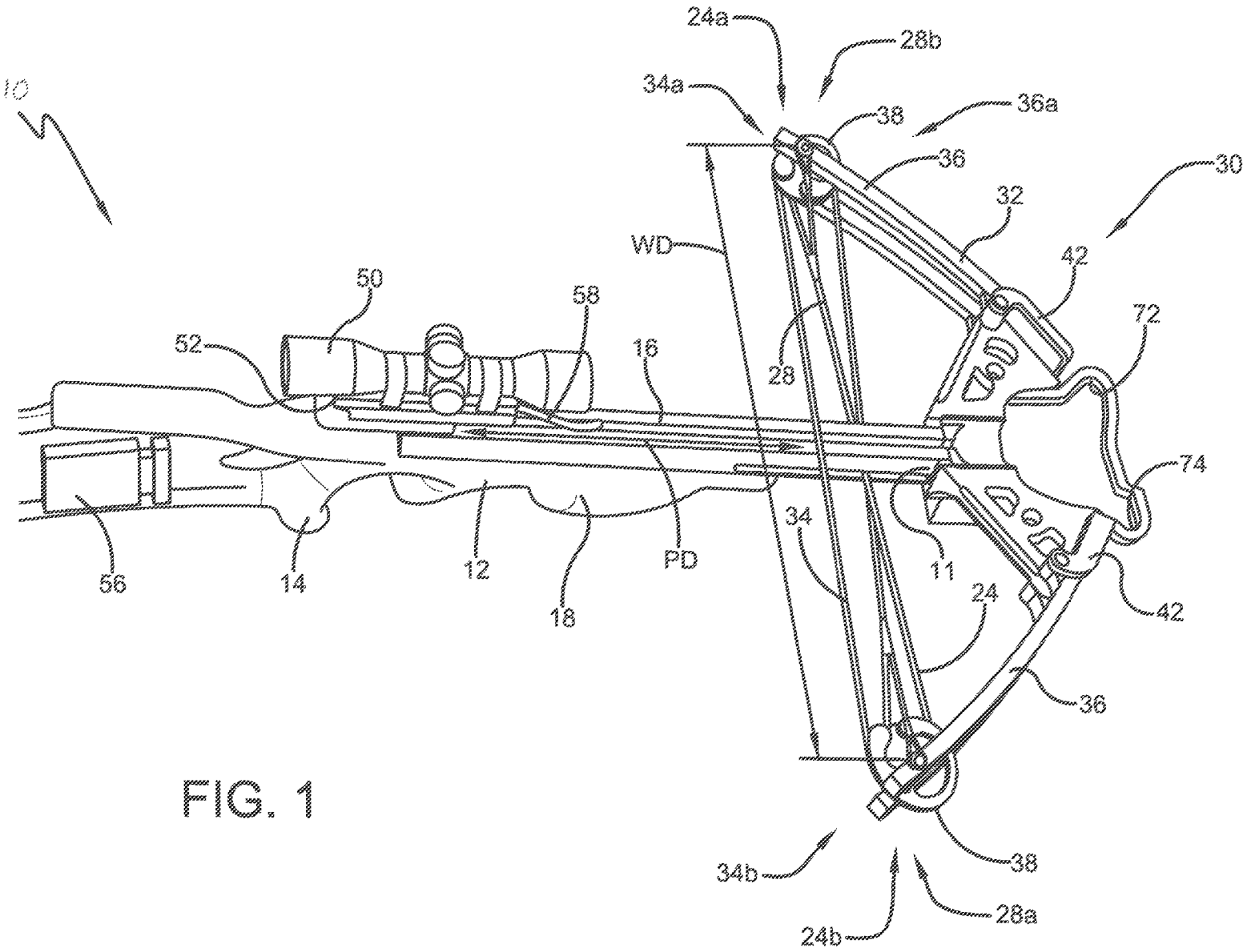
FIG. 1 is a view of one non-limiting embodiment of a crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Apparatus" means the portion of a weapon that shoots, fires or releases the projectile of a weapon. As applied to crossbows, trigger apparatus means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawing wherein the showings are for purposes of illustrating embodiments of the present subject matter only and not for purposes of limiting the same, and wherein like reference numerals are understood to refer to like components, provided are crossbow components and a method of using crossbow components.

FIG. 1 shows a crossbow 10. While the crossbow 10 shown uses a compound bow, it should be understood that this invention will work well with any type of crossbow chosen with sound judgment by a person of ordinary skill in the art.

The crossbow 10 has a main beam 12 having a distal end 11. The main beam 12 may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. The crossbow 10 also includes a bow assembly 30 adapted to propel an associated arrow and having a bow 32 and a bowstring 34. The bowstring 34 may have a first end of the bowstring 34*a* and a second end of the bowstring 34*b*. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in an operational manner. In each of the non-limiting embodiments, the set of limbs has a first side 36*a* and a second side 36*b* opposite the first side 36*a* with first side 36*a* being operationally engaged with a first cam 38 and second side 36*b* being operationally engaged with a second cam 38. The bow may include a first power cord 24 having a first end 24*a* and a second end 24*b*. The bow may include a second power cord 28 having a first end 28*a* and a second end 28*b*. The bow may also include a riser 40. The riser 40 may comprise a set of limb pockets 42, 42 adapted to receive the limbs 36, 36, as shown in FIG. 1.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56, and arrow holder 58. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

A crossbow may comprise a bow assembly mounted with the bowstring cams rearward of the riser, or mounted with the bowstring cams forward of the riser. A crossbow with the bow assembly mounted with the bowstring cams rearward of the riser is sometimes referred to as a conventional crossbow, while a crossbow with the bow assembly mounted with the bowstring cams forward of the riser is sometimes referred to as a reversed crossbow. The subject matter herein applies to both conventional crossbows and reversed crossbows.

A crossbow 10 may comprise a crossbow router system 1000, 2000 adapted to route one or more power cords 24, 28 across the main beam 12 order to promote efficiency in crossbow operation.

In a first non-limiting embodiment a crossbow router system 1000 may comprise a first elongated frame 100, a second elongated frame 110, a first elongated shaft 120, a second elongated shaft 130, a third elongated shaft 140, a fourth elongated shaft 150, a first cylindrical bushing 160, a second cylindrical bushing 170, a third cylindrical bushing 180, and a fourth cylindrical bushing 190.

The first elongated frame 100 may comprise a first frame end 101*a* and a second frame end 101*b* offset from the first frame end 101*a* along a first frame axis of elongation 102. The first elongated frame 100 may define a first rotational axis of the first elongated frame 103. The first elongated frame 100 may define a second rotational axis of the first elongated frame 104 parallel to the first rotational axis of the first elongated frame 103 and offset from the first rotational axis of the first elongated frame 103 by a second offset distance of the first frame 105. The first elongated frame 100 may define a third rotational axis of the first elongated frame 106 parallel to the first rotational axis of the first elongated frame 103 and offset from the first rotational axis of the first elongated frame 103 by a third offset distance of the first frame 107. The first elongated frame 100 may define a fourth rotational axis of the first elongated frame 108 parallel to the first rotational axis of the first elongated frame 103 and offset from the first rotational axis of the first elongated frame 103 by a fourth offset distance of the first frame 109. The first elongated frame 100 may define a first interior surface 101*c*.

The second elongated frame 110 may comprise a first frame end 111*a* and a second frame end 111*b* offset from the first frame end 111*a* along a second frame axis of elongation 112. The second elongated frame 110 may define a first rotational axis of the second elongated frame 113. The second elongated frame 110 may define a second rotational axis of the second elongated frame 114 parallel to the first rotational axis of the second elongated frame 113 and offset from the first rotational axis of the second elongated frame 113 by a second offset distance of the second frame 115. The second elongated frame 110 may define a third rotational axis of the second elongated frame 116 parallel to the first rotational axis of the second elongated frame 113 and offset from the first rotational axis of the second elongated frame 113 by a third offset distance of the second frame 117. The second elongated frame 110 may define a fourth rotational axis of the second elongated frame 118 parallel to the first rotational axis of the second elongated frame 113 and offset from the first rotational axis of the second elongated frame 113 by a fourth offset distance of the second frame 119. The second elongated frame 110 may define a second interior surface 111*c*.

In a first non-limiting embodiment, a crossbow router system 1000, the first rotational axis of the first elongated frame 103 may be coincident with the first rotational axis of the second elongated frame 113; the second rotational axis of the first elongated frame 104 may be coincident with the second rotational axis of the second elongated frame 114; the third rotational axis of the first elongated frame 106 may be coincident with the third rotational axis of the second elongated frame 116; the fourth rotational axis of the first elongated frame 108 may be coincident with the fourth rotational axis of the second elongated frame 118; and the first interior surface 101*c* faces and is offset from the second interior surface 111*c* by an interior width 91.

The first elongated shaft 120 may define a first shaft axis 121 coincident with the first rotational axis of the first elongated frame 103, and the first rotational axis of the second elongated frame 113. The first elongated shaft 120 may comprise a mechanical connector, such as, without limitation, a pin or bolt, operationally joining the first elongated frame 100 to the second elongated frame 111.

The second elongated shaft 130 may define a second shaft axis 131 coincident with the second rotational axis of the first elongated frame 104, and the second rotational axis of the second elongated frame 114. The second elongated shaft 130 may comprise a mechanical connector, such as, without limitation, a pin or bolt, operationally joining the first elongated frame 100 to the second elongated frame 111.

The third elongated shaft 140 may define a third shaft axis 141 coincident with the third rotational axis of the first elongated frame 106, and the third rotational axis of the second elongated frame 116. The third elongated shaft 140 may comprise a mechanical connector, such as, without limitation, a pin or bolt, operationally joining the first elongated frame 100 to the second elongated frame 111.

The fourth elongated shaft 150 may define a fourth shaft axis 151 coincident with the fourth rotational axis of the first elongated frame 108, and the fourth rotational axis of the second elongated frame 118. The fourth elongated shaft 150 may comprise a mechanical connector, such as, without limitation, a pin or bolt, operationally joining the first elongated frame 100 to the second elongated frame 111.

The first cylindrical bushing 160 may define a first cylindrical axis 162. The first cylindrical axis 162 may be coincident with the first shaft axis 121. In some embodiments, the first cylindrical bushing 160 is operationally engaged with the first elongated shaft 120 to rotate thereabout.

The second cylindrical bushing 170 may define a second cylindrical axis 172. The second cylindrical axis 172 may be coincident with the second shaft axis 131. In some embodiments, the second cylindrical bushing 170 is operationally engaged with the second elongated shaft 130 to rotate thereabout.

The third cylindrical bushing 180 may define a third cylindrical axis 182. The third cylindrical axis 182 may be coincident with the third shaft axis 141. In some embodiments, the third cylindrical bushing 180 is operationally engaged with the third elongated shaft 140 to rotate thereabout.

The fourth cylindrical bushing 190 may define a fourth cylindrical axis 192. The fourth cylindrical axis 192 may be coincident with the fourth shaft axis 151 In some embodiments, the fourth cylindrical bushing 190 is operationally engaged with the fourth elongated shaft 150 to rotate thereabout.

Figure 3:
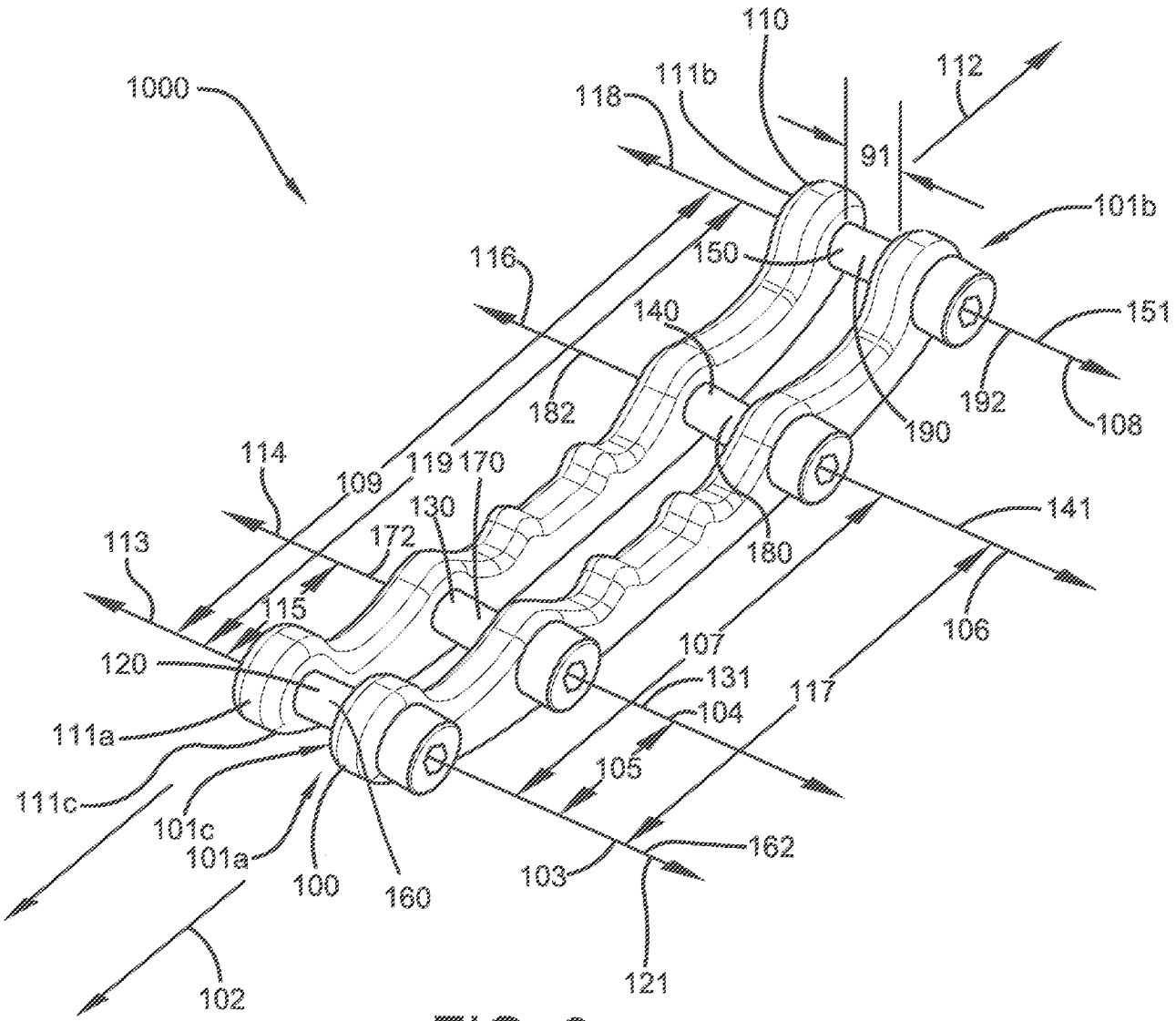
FIG. 3 is a view of one non-limiting embodiment of a power cord router.

Referring now to FIG. 3, shown is one non limiting embodiment of a crossbow router system 1000. In the non-limiting embodiment shown, the crossbow router system 1000 is adapted to operationally engage two power cords simultaneously and to provide guidance for the power cords to move along a path parallel to or substantially parallel to the first frame axis of elongation 102. Further, in the non-limiting embodiment shown, the crossbow router system 1000 has four cylindrical bushings 160, 170, 180, 190 all adapted to operate as friction reducing bearings adapted to operationally engage the power cords and to facilitate their efficient operation by reducing friction losses, or misalignment losses, or a combination thereof.

Figure 2:
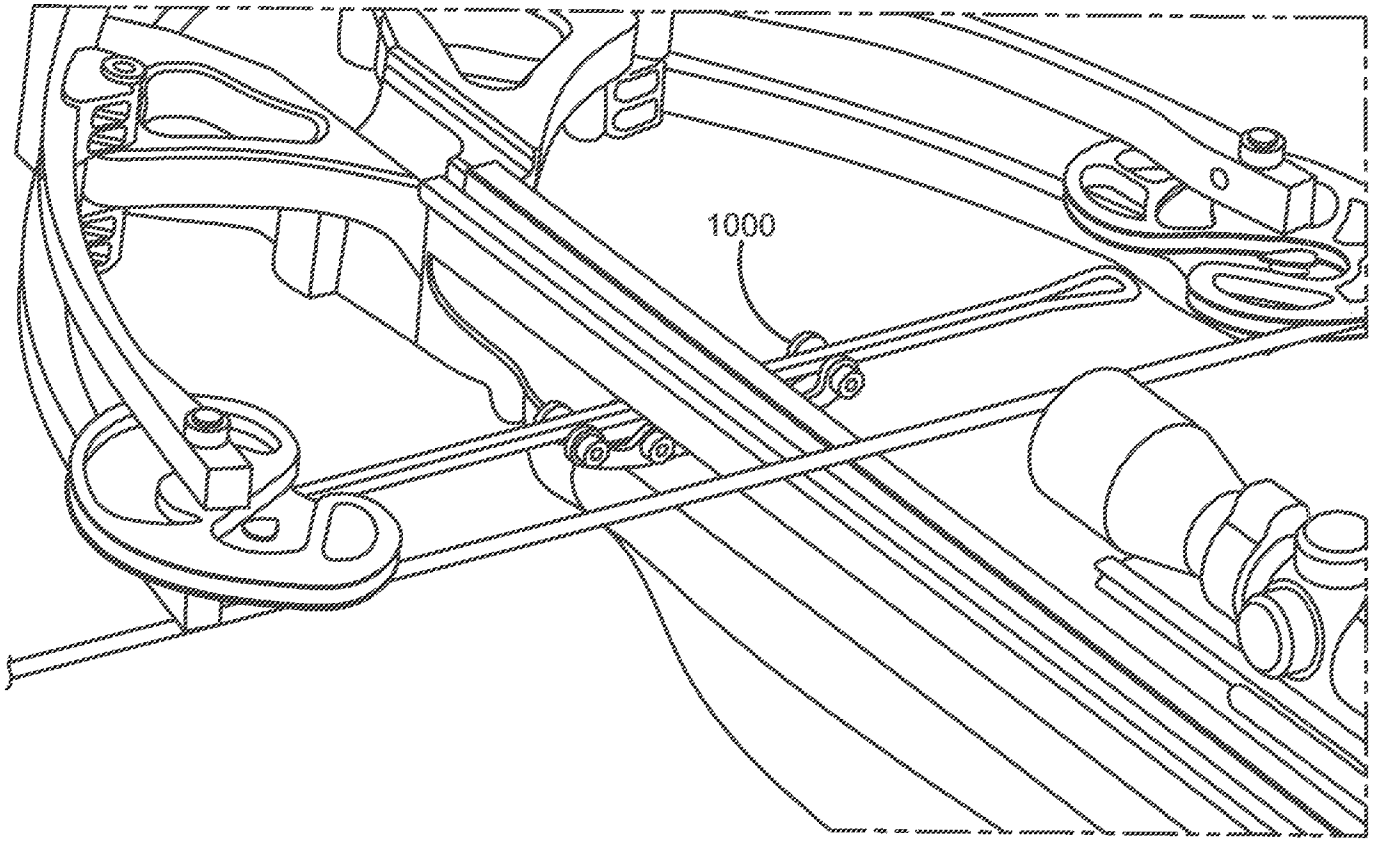
FIG. 2 is a view of one non-limiting embodiment of a crossbow comprising a power cord router.

As shown in FIG. 2, a crossbow router system 1000 may be engaged with the main beam 12 of a crossbow 10 and the power cords 24, 28 of the crossbow 10. In some embodiments the crossbow router system 1000 is engaged with the crossbow 10 such that the first frame axis of elongation 102 is perpendicular or within a few degrees of perpendicular to the main beam 12.

In a second non-limiting embodiment a crossbow router system 2000 may comprise a first elongated frame 200, a second elongated frame 210, a first elongated shaft 220, a second elongated shaft 230, a first cylindrical bushing 260, a second cylindrical bushing 270; and a cable saver 290.

The first elongated frame 200 may comprise a first frame end 201*a* and a second frame end 201*b* offset from the first frame end 201*a* along a first frame axis of elongation 202. The first elongated frame 200 may define a first rotational axis of the first elongated frame 203. The first elongated frame 200 may define a second rotational axis of the first elongated frame 204 parallel to the first rotational axis of the first elongated frame 203 and offset from the first rotational axis of the first elongated frame 203 by a second offset distance of the first frame 205. The first elongated frame 200 may define a first interior surface 101*c*.

The second elongated frame 210 may comprise a first frame end 211*a* and a second frame end 211*b* offset from the first frame end 211*a* along a second frame axis of elongation 212. The second elongated frame 210 may define a first rotational axis of the second elongated frame 213. The second elongated frame 210 may define a second rotational axis of the second elongated frame 214 parallel to the first rotational axis of the second elongated frame 213 and offset from the first rotational axis of the second elongated frame 213 by a second offset distance of the second frame 215. The second elongated frame 210 may define a second interior surface 211*c*.

In a first non-limiting embodiment, a crossbow router system 2000, the first rotational axis of the first elongated frame 203 may be coincident with the first rotational axis of the second elongated frame 213; the second rotational axis of the first elongated frame 204 may be coincident with the second rotational axis of the second elongated frame 214; and the first interior surface 201*c* faces and is offset from the second interior surface 211*c* by an interior width 95.

The first elongated shaft 220 may define a first shaft axis 221 coincident with the first rotational axis of the first elongated frame 203, and the first rotational axis of the second elongated frame 213. The first elongated shaft 220 may comprise a mechanical connector, such as, without limitation, a pin or bolt, operationally joining the first elongated frame 200 to the second elongated frame 211.

The second elongated shaft 230 may define a second shaft axis 231 coincident with the second rotational axis of the first elongated frame 204, and the second rotational axis of the second elongated frame 214. The second elongated shaft 230 may comprise a mechanical connector, such as, without limitation, a pin or bolt, operationally joining the first elongated frame 200 to the second elongated frame 211.

The first cylindrical bushing 260 may define a first cylindrical axis 262. The first cylindrical axis 262 may be coincident with the first shaft axis 221. In some embodiments, the first cylindrical bushing 260 is operationally engaged with the first elongated shaft 220 to rotate thereabout.

The second cylindrical bushing 270 may define a second cylindrical axis 272. The second cylindrical axis 272 may be coincident with the second shaft axis 231. In some embodiments, the second cylindrical bushing 270 is operationally engaged with the second elongated shaft 230 to rotate thereabout.

The cable saver 290 may define an elongated hole defining a channel axis of elongation 292 adapted to accept a crossbow power cord during operation. The channel axis of elongation 292 may be parallel to the first frame axis of elongation 202.

Figure 4:
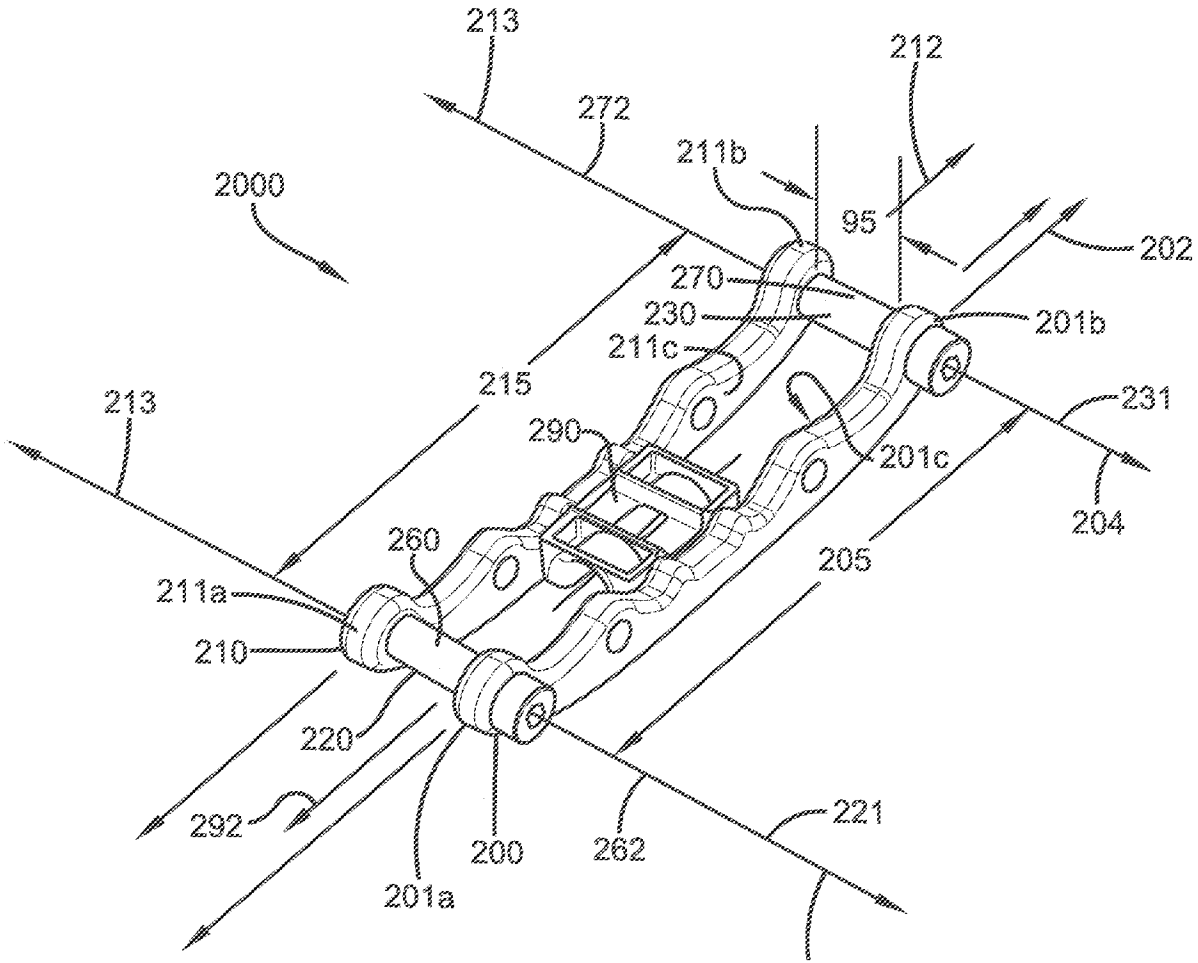
FIG. 4 is a view of a second non-limiting embodiment of a power cord router.
Figure 5:
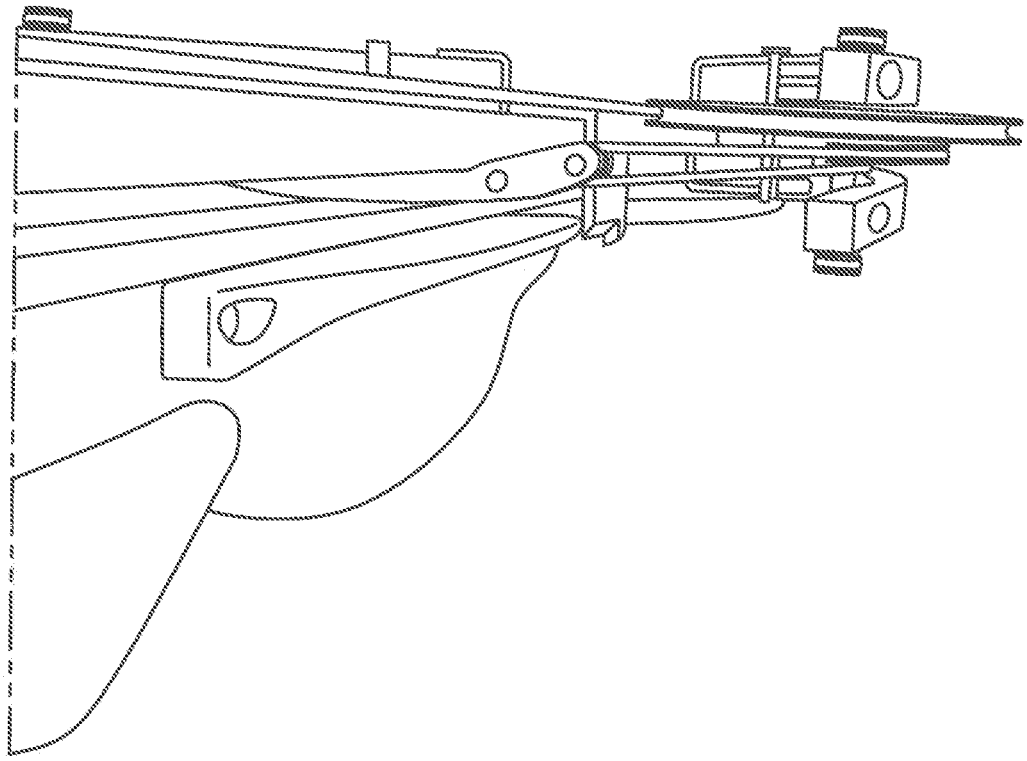
FIG. 5 is a view of one non-limiting embodiment of a crossbow comprising a power cord router.
Figure 6:
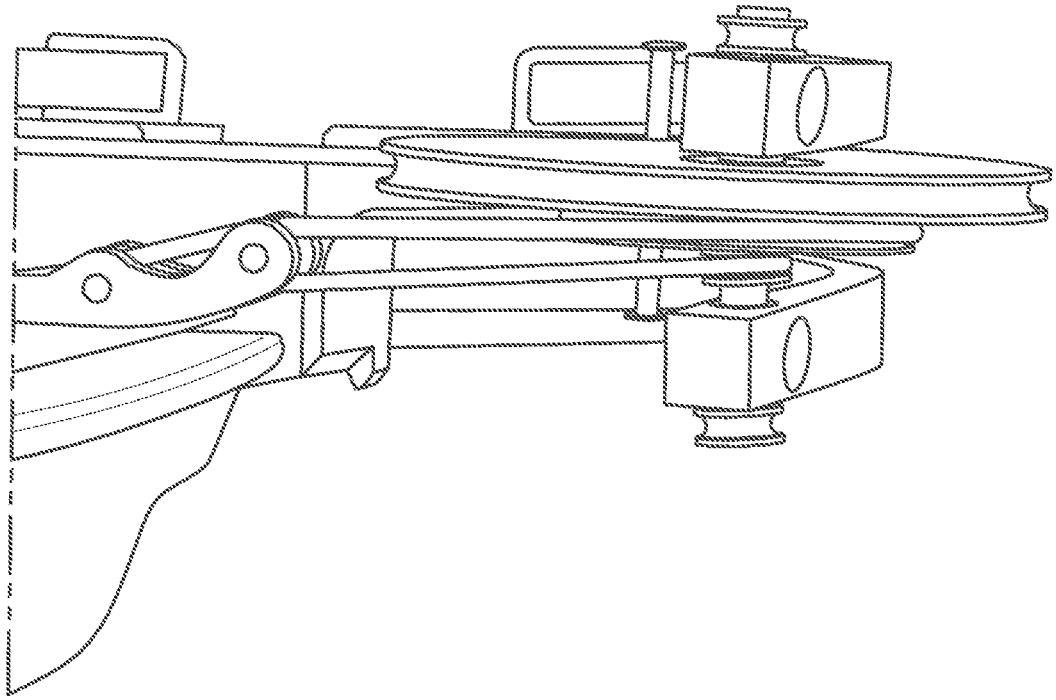
Figure 7:
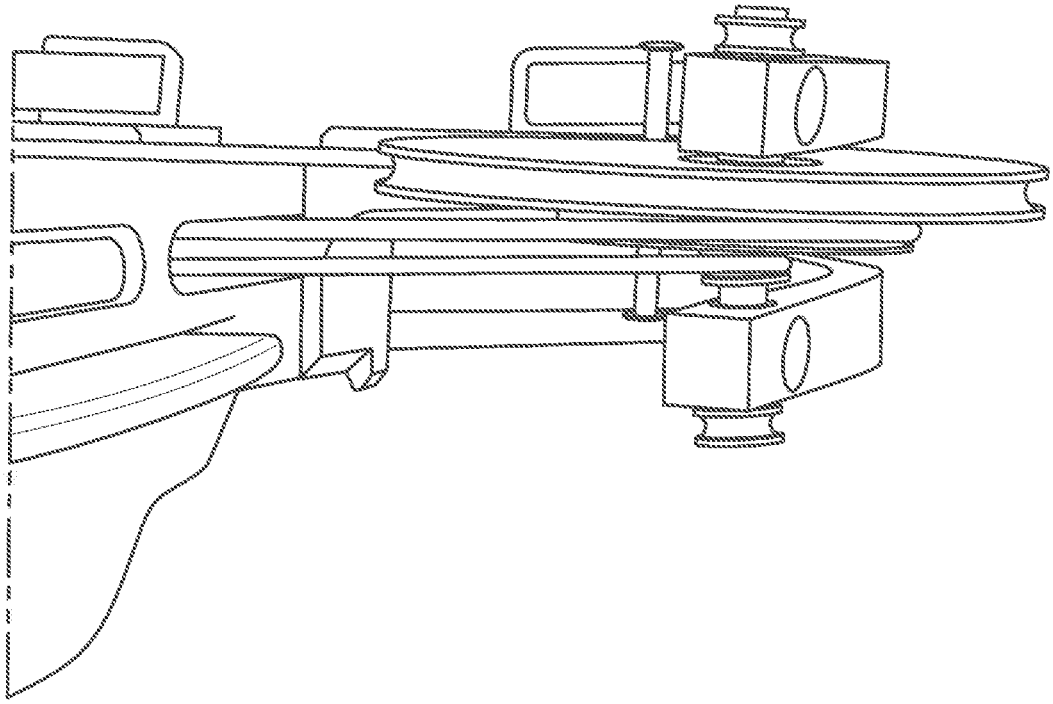
FIG. 7 is a view of the crossbow of FIG. 5 without a power cord router.
Figure 8:
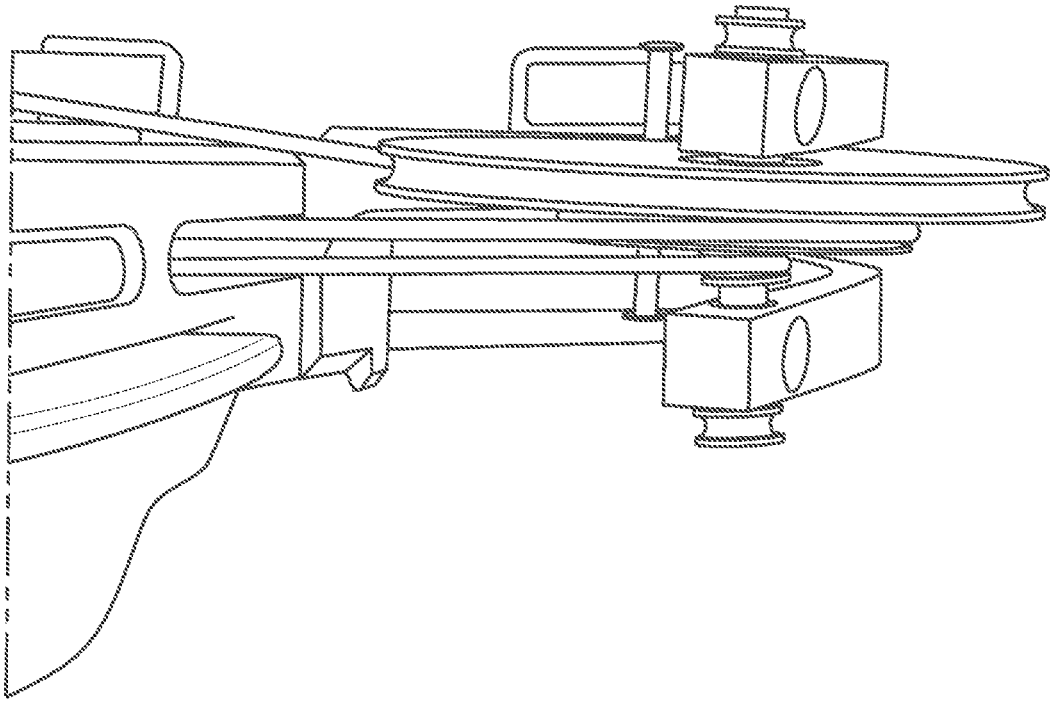
FIG. 8 is a view of the crossbow of FIG. 5 without a power cord router.

Referring now to FIG. 4, shown is one non limiting embodiment of a crossbow router system 2000. In the non-limiting embodiment shown, the crossbow router system 2000 is adapted to operationally engage two power cords simultaneously and to provide guidance for the power cords to move along a path parallel to or substantially parallel to the first frame axis of elongation 202. Further, in the non-limiting embodiment shown, the crossbow router system 2000 has two cylindrical bushings 260, 270 adapted to operate as friction reducing bearings adapted to operationally engage the power cords and to facilitate their efficient operation by reducing friction losses, or misalignment losses, or a combination thereof.

The crossbow router system 2000 may be engaged with the main beam 12 of a crossbow 10 and the power cords 24, 28 of the crossbow 10. In some embodiments the crossbow router system 2000 is engaged with the crossbow 10 such that the first frame axis of elongation 202 is perpendicular or within a few degrees of perpendicular to the main beam 12.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A crossbow router system comprising a first elongated frame having a first frame end and a second frame end offset from the first frame end along a first frame axis of elongation, the first frame defining a first rotational axis of the first elongated frame, a second rotational axis of the first elongated frame parallel to the first rotational axis of the first elongated frame and offset from the first rotational axis of the first elongated frame by a second offset distance of the first frame, a third rotational axis of the first elongated frame parallel to the first rotational axis of the first elongated frame and offset from the first rotational axis of the first elongated frame by a third offset distance of the first frame, and a fourth rotational axis of the first elongated frame parallel to the first rotational axis of the first elongated frame and offset from the first rotational axis of the first elongated frame by a fourth offset distance of the first frame, and a first interior surface;

a second elongated frame having a first frame end and a second frame end offset from the first frame end along a second frame axis of elongation, the second frame defining a first rotational axis of the second elongated frame, a second rotational axis of the second elongated frame parallel to the first rotational axis of the second elongated frame and offset from the first rotational axis of the second elongated frame by a second offset distance of the second frame, a third rotational axis of the second elongated frame parallel to the first rotational axis of the second elongated frame and offset from the first rotational axis of the second elongated frame by a third offset distance of the second frame, and a fourth rotational axis of the second elongated frame parallel to the first rotational axis of the second elongated frame and offset from the first rotational axis of the second elongated frame by a fourth offset distance of the second frame, and a second interior surface;

wherein, the first rotational axis of the first elongated frame is coincident with the first rotational axis of the second elongated frame, the second rotational axis of the first elongated frame is coincident with the second rotational axis of the second elongated frame, the third rotational axis of the first elongated frame is coincident with the third rotational axis of the second elongated frame, the fourth rotational axis of the first elongated frame is coincident with the fourth rotational axis of the second elongated frame, and the first interior surface faces and is offset from the second interior surface by an interior width;

a first elongated shaft defining a first shaft axis, the first elongated shaft being coincident with the first rotational axis of the first elongated frame, and the first rotational axis of the second elongated frame;

a second elongated shaft defining a second shaft axis, the second elongated shaft being coincident with the second rotational axis of the first elongated frame, and the second rotational axis of the second elongated frame;

a third elongated shaft defining a third shaft axis, the third elongated shaft being coincident with the third rotational axis of the first elongated frame, and the third rotational axis of the second elongated frame;

a fourth elongated shaft defining a fourth shaft axis, the fourth elongated shaft being coincident with the fourth rotational axis of the first elongated frame, and the fourth rotational axis of the second elongated frame;

a first cylindrical bushing defining a first cylinder axis coincident with the first shaft axis;

a second cylindrical bushing defining a second cylinder axis coincident with the second shaft axis;

a third cylindrical bushing defining a third cylinder axis coincident with the third shaft axis; and a fourth cylindrical bushing defining a fourth cylinder axis coincident with the fourth shaft axis.

2. A crossbow router system comprising a first elongated frame having a first frame end and a second frame end offset from the first frame end along a first frame axis of elongation, the first frame defining a first rotational axis of the first elongated frame, a second rotational axis of the first elongated frame parallel to the first rotational axis of the first elongated frame and offset from the first rotational axis of the first elongated frame by a second offset distance of the first frame, and a first interior surface;

a second elongated frame having a first frame end and a second frame end offset from the first frame end along a second frame axis of elongation, the second frame defining a first rotational axis of the second elongated frame, a second rotational axis of the second elongated frame parallel to the first rotational axis of the second elongated frame and offset from the first rotational axis of the second elongated frame by a second offset distance of the second frame, and a second interior surface;

wherein, the first rotational axis of the first elongated frame is coincident with the first rotational axis of the second elongated frame, the second rotational axis of the first elongated frame is coincident with the second rotational axis of the second elongated frame, and the first interior surface faces and is offset from the second interior surface by an interior width;

a first elongated shaft defining a first shaft axis, the first elongated shaft being coincident with the first rotational axis of the first elongated frame, and the first rotational axis of the second elongated frame;

a second elongated shaft defining a second shaft axis, the second elongated shaft being coincident with the second rotational axis of the first elongated frame, and the second rotational axis of the second elongated frame;

a first cylindrical bushing defining a first cylinder axis coincident with the first shaft axis;

a second cylindrical bushing defining a second cylinder axis coincident with the second shaft axis; and a cable saver having an elongated hole defining a channel axis of elongation adapted to accept crossbow power cord during operation; and wherein, the channel axis of elongation is parallel to the first frame axis of elongation.

* * * * *